US011414808B2

(12) United States Patent
Yang et al.

(10) Patent No.: US 11,414,808 B2
(45) Date of Patent: Aug. 16, 2022

(54) WASHING MACHINE

(71) Applicant: WUXI LITTLE SWAN ELECTRIC CO., LTD., Wuxi (CN)

(72) Inventors: Yao Yang, Wuxi (CN); Zhangjing Li, Wuxi (CN); Wei Zhou, Wuxi (CN)

( * ) Notice: Subject to any disclaimer, the term of this patent is extended or adjusted under 35 U.S.C. 154(b) by 329 days.

(21) Appl. No.: 16/644,501

(22) PCT Filed: Nov. 2, 2017

(86) PCT No.: PCT/CN2017/109128

§ 371 (c)(1),
(2) Date: Mar. 5, 2020

(87) PCT Pub. No.: WO2019/051960

PCT Pub. Date: Mar. 21, 2019

(65) Prior Publication Data

US 2021/0087739 A1 Mar. 25, 2021

(30) Foreign Application Priority Data

Sep. 15, 2017 (CN) ..... 201710834241.X
Sep. 15, 2017 (CN) ..... 201721196715.4

(51) Int. Cl.

| | |
|---|---|
| ***D06F 39/08*** | (2006.01) |
| ***D06F 23/04*** | (2006.01) |
| ***D06F 37/12*** | (2006.01) |

(52) U.S. Cl.
CPC ..... *D06F 39/083* (2013.01); *D06F 23/04* (2013.01); *D06F 37/12* (2013.01)

(58) Field of Classification Search
CPC ..... D06F 23/04; D06F 37/12; D06F 37/145; D06F 39/083; D06F 39/10
See application file for complete search history.

(56) References Cited

U.S. PATENT DOCUMENTS

| | | | |
|---|---|---|---|
| 2013/0036776 A1 | 2/2013 | Seo et al. | |
| 2016/0083888 A1 | 3/2016 | Alexander et al. | |
| 2020/0299891 A1* | 9/2020 | Lao | D06F 23/04 |

FOREIGN PATENT DOCUMENTS

| | | |
|---|---|---|
| CN | 104452184 A | 3/2015 |
| CN | 106868774 A | 6/2017 |
| CN | 106906610 A | 6/2017 |

(Continued)

OTHER PUBLICATIONS

Machine Translation of Li et al., CN206308502, Jul. 2017. (Year: 2017).*

(Continued)

*Primary Examiner* — David G Cormier
(74) *Attorney, Agent, or Firm* — Kilpatrick Townsend & Stockton, LLP

(57) ABSTRACT

A washing machine includes a cabinet; a rotating tub rotatably provided in the cabinet, the rotating tub having a peripheral wall and/or a bottom wall provided with a water outlet; and a water guide cover provided to an internal peripheral wall face of the rotating tub and covering the water outlet, the water guide cover being provided with a water inlet and defining a water guide cavity in communication with the water inlet and the water outlet, liquid in the rotating tub lifted under the action of a centrifugal force entering the water guide cavity through the water inlet and being discharged through the water outlet.

16 Claims, 6 Drawing Sheets

(56) References Cited

FOREIGN PATENT DOCUMENTS

| | | | |
|---|---|---|---|
| CN | 106988074 | A | 7/2017 |
| CN | 206308502 | U | 7/2017 |
| CN | 207227754 | U | 4/2018 |
| JP | S50136969 | U | 11/1975 |
| JP | S59171590 | A | 9/1984 |
| JP | 2009000463 | A | 1/2009 |
| JP | 2013141508 | A | 7/2013 |

OTHER PUBLICATIONS

OA for JP application 2020-502099.
OA for CN application 201910325425.2.
The first Office Action dated Jul. 2, 2018 in the corresponding CN application No. 201710834241.X.
The second Office Action dated Mar. 11, 2019 in the corresponding CN application No. 201710834241.X.
International Search Report dated May 23, 2018 in the corresponding International Application No. PCT/CN2017/109128.

* cited by examiner

WASHING MACHINE

CROSS-REFERENCES TO RELATED APPLICATIONS

The present disclosure is a national phase application of International Application No. PCT/CN2017/109128, filed on Nov. 2, 2017, which claims the priorities of Chinese Application No. 201721196715.4 and 201710834241.X, filed in the Chinese Patent Office on Sep. 15, 2017, the entireties of which are herein incorporated by reference.

FIELD

The present disclosure relates to a technical field of electric appliance manufacturing, more particularly to a washing machine.

BACKGROUND

With development of technology of washing machines, a washing machine has a trend of having a large capacity. While the washing machine gradually tends to be of large capacity, an overall size of the washing machine will necessarily increase. Thus it is quite necessary to provide a washing machine with small volume and large capacity. Meanwhile, during washing of an existing washing machine, water is distributed in a rotating tub and a water containing tub, that is, the water is also distributed between the water containing tub and the rotating tub, which has large water consumption and causes waste of water resources. For the existing washing machine, dirt is liable to remain between the water containing tub and the rotating tub, to breed bacteria. Furthermore, since the water is distributed between the water containing tub and the rotating tub, detergent consumption is also large, this causes waste of detergent resources and is not conducive to cost savings.

In view of this, in the related art, a washing machine is proposed, in which the water containing tub is omitted and only the rotating tub remains, and a cabinet is configured as a structure of inner and outer layers. During spin-drying, the inner layer of the cabinet is used to guide the water spun out by the water containing tub to be discharged. However, since the inner layer needs to guide the water, it can only employ materials of higher waterproofness such as plastic. Furthermore, the inner and outer layers of the cabinet are integrally formed, the outer layer of the cabinet can only employ materials such as plastic as well. Therefore, materials such as metal plate cannot be employed, restricting appearance of the washing machine.

SUMMARY

The present disclosure seeks to solve at least one of the problems existing in the related art to at least some extent. To this end, the present disclosure proposes a washing machine employing a single tub structure, which is not only capacious, water-saving, dirt-free and cost effective, but also has no restrictions on materials of a cabinet while ensuring dehydration effect, to improve diversity of appearance.

The present disclosure further proposes a rotating tub for the washing machine.

Embodiments of a first aspect of the present disclosure propose a washing machine. The washing machine includes a cabinet, a rotating tub, and a water guide cover. The rotating tub is rotatably provided in the cabinet, and the rotating tub has a peripheral wall and/or a bottom wall provided with a water outlet. The water guide cover is provided to an internal peripheral wall face of the rotating tub and covers the water outlet, the water guide cover is provided with a water inlet and defines a water guide cavity in communication with the water inlet and the water outlet, and liquid in the rotating tub lifted under the action of a centrifugal force enters the water guide cavity through the water inlet and is discharged through the water outlet.

In the washing machine according to embodiments of the present disclosure, the water containing tub is omitted and only the rotating tub is provided to form the single tub structure, to increase capacity, save water, avoid dirt and reduce costs. Furthermore, the washing machine is configured as a structure of the rotating tub and the water guide cover, and the water guide cover is used to guide the water in the rotating tub lifted under the centrifugal force to be discharged, not only the dehydration effect is improved, but also there is no limit on the materials of the cabinet, the cabinet is allowed to employ metal materials such as metal plate to promote appearance. In addition, the water outlet is provided in the peripheral wall of the rotating tub, facilitating sealing connection between the water guide cover and the rotating tub.

According to some embodiments of the present disclosure, the water inlet is provided in an upper portion of the water guide cover, and the water outlet is provided in a lower portion of the peripheral wall of the rotating tub.

Further, the water inlet is provided in an upper end of the water guide cover, and the water outlet is provided close to the bottom wall of the rotating tub.

According to some embodiments of the present disclosure, the water guide cavity of the water guide cover is defined by the water guide cover alone, or defined by the water guide cover and the internal peripheral wall face of the rotating tub together.

According to some embodiments of the present disclosure, a plurality of water outlets are provided and arranged in a circumferential direction of the rotating tub and spaced apart from each other; a plurality of water guide covers are provided and arranged in the circumferential direction of the rotating tub and spaced apart from each other; and each water guide cover covers at least one corresponding water outlet.

According to some embodiments of the present disclosure, the washing machine includes a water guide plate and a sealing edge. The sealing edge extends from the water guide plate towards and close to the internal peripheral wall face of the rotating tub, the sealing edge is connected with a seal to the internal peripheral wall face of the rotating tub, and the water guide plate, the sealing edge and the internal peripheral wall face of the rotating tub collectively define the water guide cavity.

According to some embodiments of the present disclosure, the sealing edge extends from two side edges and a lower edge of the water guide plate towards and close to the internal peripheral wall face of the rotating tub.

Further, the water inlet is provided in the sealing edge.

Further, the sealing edge has an upper end lower than an upper end of the water guide plate to define the water inlet in the upper end of the sealing edge.

In some examples of the present disclosure, the sealing edge is connected with a seal to the internal peripheral wall face of the rotating tub through a sealing member provided between the sealing edge and the internal peripheral wall face of the rotating tub.

Further, the sealing edge has a surface facing the internal peripheral wall face of the rotating tub and provided with a mounting groove, and at least a portion of the sealing member is assembled in the mounting groove.

Further, the sealing member includes an outer sealing strip and an inner sealing strip located at an inner side of the outer sealing strip, and a first end of the outer sealing strip is connected to a first end of the inner sealing strip and a second end of the outer sealing strip is connected to a second end of the inner sealing strip; the mounting groove includes an outer mounting groove segment and an inner mounting groove segment located at an inner side of the outer mounting groove segment, and a first end of the outer mounting groove segment is connected to a first end of the inner mounting groove segment and a second end of the outer mounting groove segment is connected to a second end of the inner mounting groove segment; at least a portion of the outer sealing strip is fitted in the outer mounting groove segment, and at least a portion of the inner sealing strip is fitted in the inner mounting groove segment.

Further, the sealing edge is provided with several mounting holes located between the outer mounting groove segment and the inner mounting groove segment, and the sealing edge is mounted to the internal peripheral wall face of the rotating tub through several fasteners respectively fitted in the several mounting holes.

Further, the lower edge of the water guide plate and a bottom of the sealing edge are configured to be arc shapes matching each other and protruding downwards.

Further, the washing machine also includes a balancing ring provided at and connected to an upper end of the rotating tub, an upper end of the water guide cover is close to the balancing ring or connected to the balancing ring, and the water inlet is provided in the upper end of the water guide cover.

According to some embodiments of the present disclosure, the washing machine further includes a water receiving pan provided in the cabinet and having at least a portion located below the rotating tub, the water guide cavity is configured to guide liquid spun out by the rotating tub to the water receiving pan through the water outlet.

Further, the water receiving pan has a water receiving groove therein, and the water receiving groove is provided with a drain port at the lowest area thereof.

Further, the water receiving pan has a side peripheral wall extending upwards and higher than the water outlet.

In some specific examples of the present disclosure, the washing machine further includes a pulsator rotatably provided in the rotating tub. According to some embodiments of the present disclosure, the washing machine further includes a drive unit mounted to the water receiving pan and configured to drive at least one of the rotating tub and the pulsator to rotate.

According to some examples of the present disclosure, the water guide cover is connected to the peripheral wall and/or the bottom wall of the rotating tub by means of at least one of welding, riveting, and adhering/bonding.

According to some examples of the present disclosure, the water guide cover and the rotating tub are integrally formed; or the water guide cover and the rotating tub are separately formed and then assembled together.

Embodiments of a second aspect of the present disclosure propose a washing machine. The washing machine includes a cabinet, a rotating tub, a water guide cover and a pulsator. The rotating tub is rotatably provided in the cabinet, and the rotating tub has a peripheral wall and/or a bottom wall provided with a water outlet. The water guide cover is provided to an internal peripheral wall face of the rotating tub and covers the water outlet, the water guide cover is provided with a water inlet and defines a water guide cavity in communication with the water inlet and the water outlet, and liquid in the rotating tub lifted under the action of a centrifugal force enters the water guide cavity through the water inlet and is discharged through the water outlet. The pulsator is rotatably provided in the rotating tub.

The washing machine according to embodiments of the present disclosure employs the single tub structure to increase capacity, save water, avoid dirt and reduce costs; furthermore, not only the dehydration effect can be ensured, but also there is no limit on the materials of the cabinet, the cabinet is allowed to employ metal materials such as metal plate to promote appearance.

BRIEF DESCRIPTION OF THE DRAWINGS

Embodiments of the present disclosure will become apparent and more readily appreciated from the following descriptions made with reference to the drawings, in which.

Figure 1:
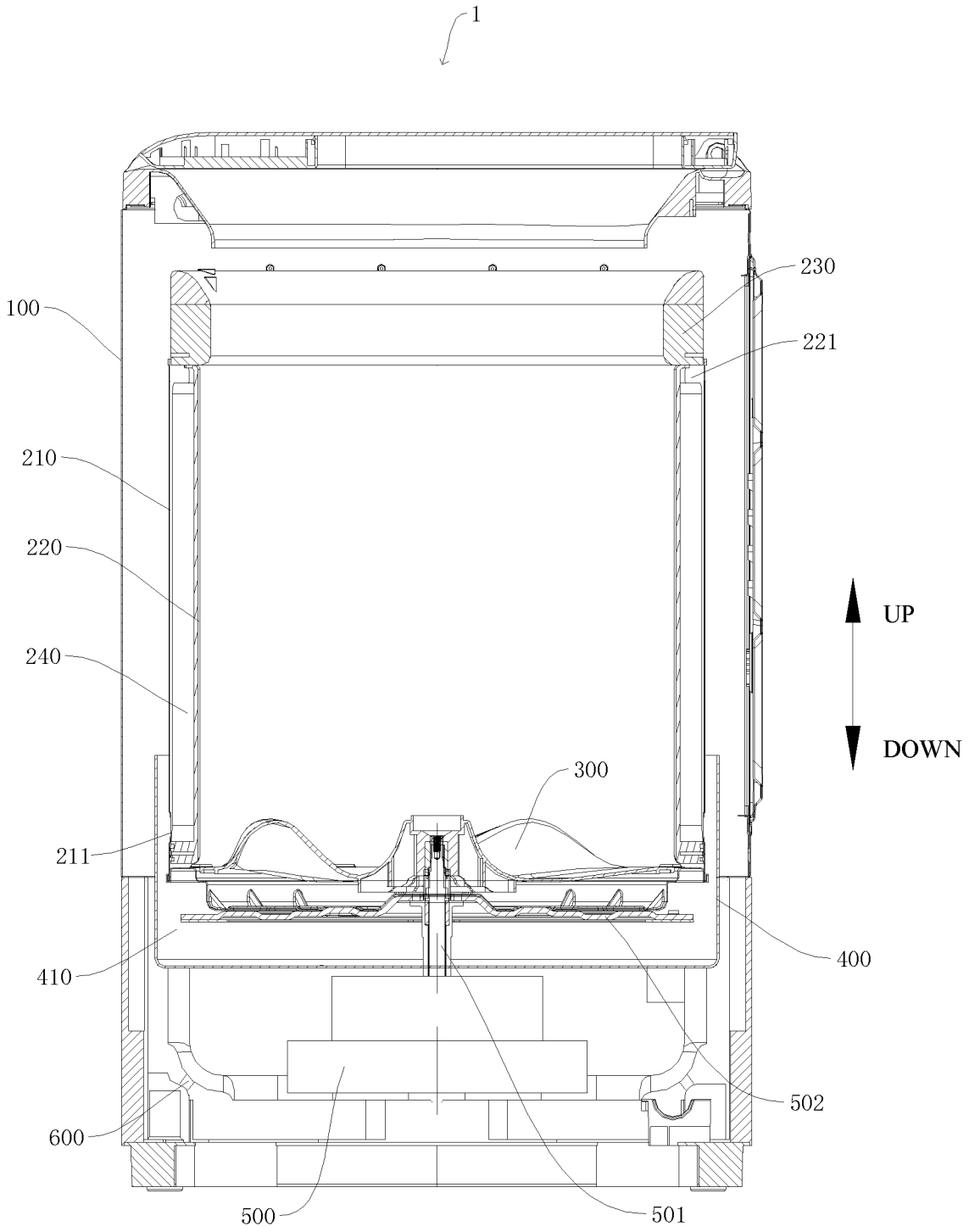
FIG. 1 is a sectional view of a washing machine according to an embodiment of the present disclosure.

REFERENCE NUMERALS washing machine 1;
cabinet 100;
rotating tub 210; water outlet 211; water guide cover 220; water inlet 221; balancing ring 230; water guide cavity 240; water guide plate 250; sealing edge 260; mounting groove 270; outer mounting groove segment 271; inner mounting groove segment 272; sealing member 280; outer sealing strip 281; inner sealing strip 282; mounting hole 290;
pulsator 300;
water receiving pan 400; water receiving groove 410;
drive unit 500; drive shaft assembly 501; support plate 502;
supporting and damping assembly 600.

DETAILED DESCRIPTION OF THE DISCLOSURE

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, illustrative, and used to generally understand the present disclosure. The embodiments shall not be construed to limit the present disclosure.

In the specification, it is to be understood that terms such as "upper," "lower," "vertical," "horizontal," "top," "bottom," "inner," "outer," "axial," "radial," and "circumferential" should be construed to refer to the orientation as then described or as shown in the drawings under discussion. These relative terms are for convenience of description and do not require that the present disclosure be constructed or operated in a particular orientation. Furthermore, in the description of the present disclosure, the term "a plurality of" means two or more than two, unless specified otherwise.

In the description of the present disclosure, unless specified or limited otherwise, it should be noted that, terms "mounted," "connected" and "coupled" may be understood broadly, such as permanent connection or detachable connection, electronic connection or mechanical connection, direct connection or indirect connection via intermediary, inner communication or interaction between two elements.

A washing machine 1 according to embodiments of the present disclosure will be described below with reference to the drawings.

As illustrated in FIGS. 1 to 6, the washing machine 1 according to embodiments of the present disclosure includes a cabinet 100, a rotating tub 210 and a water guide cover 220.

The rotating tub 210 is rotatably provided in the cabinet 100, the rotating tub 210 has a peripheral wall and/or a bottom wall provided with a water outlet 211. The water guide cover 220 is provided to an internal peripheral wall face of the rotating tub 210 and covers the water outlet 211, and the water guide cover 220 is provided with a water inlet 221 and defines a water guide cavity 240 in communication with the water inlet 221 and the water outlet 211. Liquid in the rotating tub 210 lifted under the action of a centrifugal force enters the water guide cavity 240 through the water inlet 221 and is discharged through the water outlet 211.

Specifically, during spin-drying of the washing machine 1, the rotating tub 210 rotates, that is, the water guide cover 220 rotates with the rotating tub 210, the liquid in the rotating tub 210 moves upwards under the action of the centrifugal force, and enters the water guide cavity 240 via the water inlet 221. The liquid entering the water guide cavity 240 is guided by the water guide cover 220 to the water outlet 211, and discharged through the water outlet 211.

The washing machine 1 according to embodiments of the present disclosure employs a single tub structure, that is, only the rotating tub 210 is provided without providing a water containing tub, the water is in the rotating tub 210 during washing, to save more water. Furthermore, the water guide cover 220 is further provided to the internal peripheral wall face of the rotating tub 210, the water inlet 221 is provided in the water guide cover 220, and the water outlet 211 is provided in the peripheral wall and/or the bottom wall of the rotating tub 210, the water in the rotating tub 210 is lifted under the action of the centrifugal force during spin-drying, enters the water guide cover 220 via the water inlet 221, flows to the water outlet 211 under guidance of the water guide cover 220, and is discharged through the water outlet 211. Thus, the water containing tub is canceled to simplify the structure, increase the capacity, reduce dirt and bacteria breeding, and save water while improving dehydration effect.

Moreover, the water guide cover 220 is connected to the rotating tub 210, it is unnecessary to provide additional structure to the cabinet 100 or to configure the cabinet 100 to be a structure of inner and outer layers to realize water guidance during spin-drying, selection for material of the cabinet 100 is not limited, for example, a metal plate or other materials can be used, to promote appearance.

The water outlet 211 may be provided in the peripheral wall of the rotating tub 210, or may be provided in the bottom wall of the rotating tub 210, or may be provided in both of the peripheral wall and the bottom wall. Specifically, the water outlet 211 is provided in the peripheral wall of the rotating tub 210, the water guide cover 220 covers the water outlet 211, and a lower end of the water guide cover 220 is only connected to the peripheral wall of the rotating tub 210, to facilitate sealing of the water guide cover 220 and the peripheral wall of the rotating tub 210. In one embodiment, the water outlet 211 in the present disclosure may also be provided in the bottom wall of the rotating tub 210, and the water guide cover 220 covers the water outlet 211, to facilitate improvement of dehydration efficiency and dehydration effect during spin-drying, and effective reduction of water splashing from the water outlet 211. The water outlet 211 is provided in both of the peripheral wall and the bottom wall, the sealing of the water guide cover 220 and the peripheral wall of the rotating tub 210 is facilitated, the dehydration efficiency during spin-drying is improved, and the water is effectively prevented form splashing from the water outlet 211.

Therefore, the washing machine 1 according to embodiments of the present disclosure has advantages of being capacious, water-saving, dirt-free and cost effective, having good dehydration efficiency and aesthetic appearance, and being easy to seal, etc.

The washing machine 1 according to a embodiment of the present disclosure will be described below with reference to the drawings.

As illustrated in FIGS. 1 to 6, the washing machine 1 according to embodiments of the present disclosure includes a cabinet 100, a rotating tub 210, a water guide cover 220, a pulsator 300, a water receiving pan 400, a drive unit 500 and a supporting and damping assembly 600.

The pulsator 300 is rotatably provided in the rotating tub 210. The water receiving pan 400 is provided in the cabinet 100 and has at least a portion thereof located below the rotating tub 210. The water receiving pan 400 is used to support the rotating tub 210, and it may be a direct support or an indirect support herein. In the present embodiment, the drive unit 500 is mounted to the water receiving pan 400, e.g. to a lower surface of the water receiving pan 400, for driving at least one of the rotating tub 210 and the pulsator 300 to rotate. The drive unit 500 is provided with a drive shaft assembly 501, which passes through the water receiving pan 400, and is connected to and cooperates with the water receiving pan 400, a support plate 502 connected to the drive shaft assembly 501 is provided between the water receiving pan 400 and the rotating tub 210, and the support plate 502 is fixedly connected to the rotating tub 210. The water guide cavity 240 guides the liquid spun out by the rotating tub 210 to the water receiving pan 400 through the water outlet 211. The water receiving pan 400 has a water receiving groove 410 therein, and the water receiving groove 410 is provided with a drain port at the lowest area thereof to drain water. The water receiving pan 400 may also not be provided with the drain port, but uses a conduit or the like to extract the water in the water receiving groove 410. The supporting and damping assembly 600 is mounted in the cabinet 100 and is connected to the water receiving pan 400.

Thus, by providing the water receiving pan 400, not only the liquid discharged from the water guide cavity 240 can be collected, but also the drive unit 500 and the supporting and damping assembly 600 can be mounted to the water receiving pan 400, realizing the function of bearing the drive unit 500 and supporting the rotating tub 210.

Figure 5:
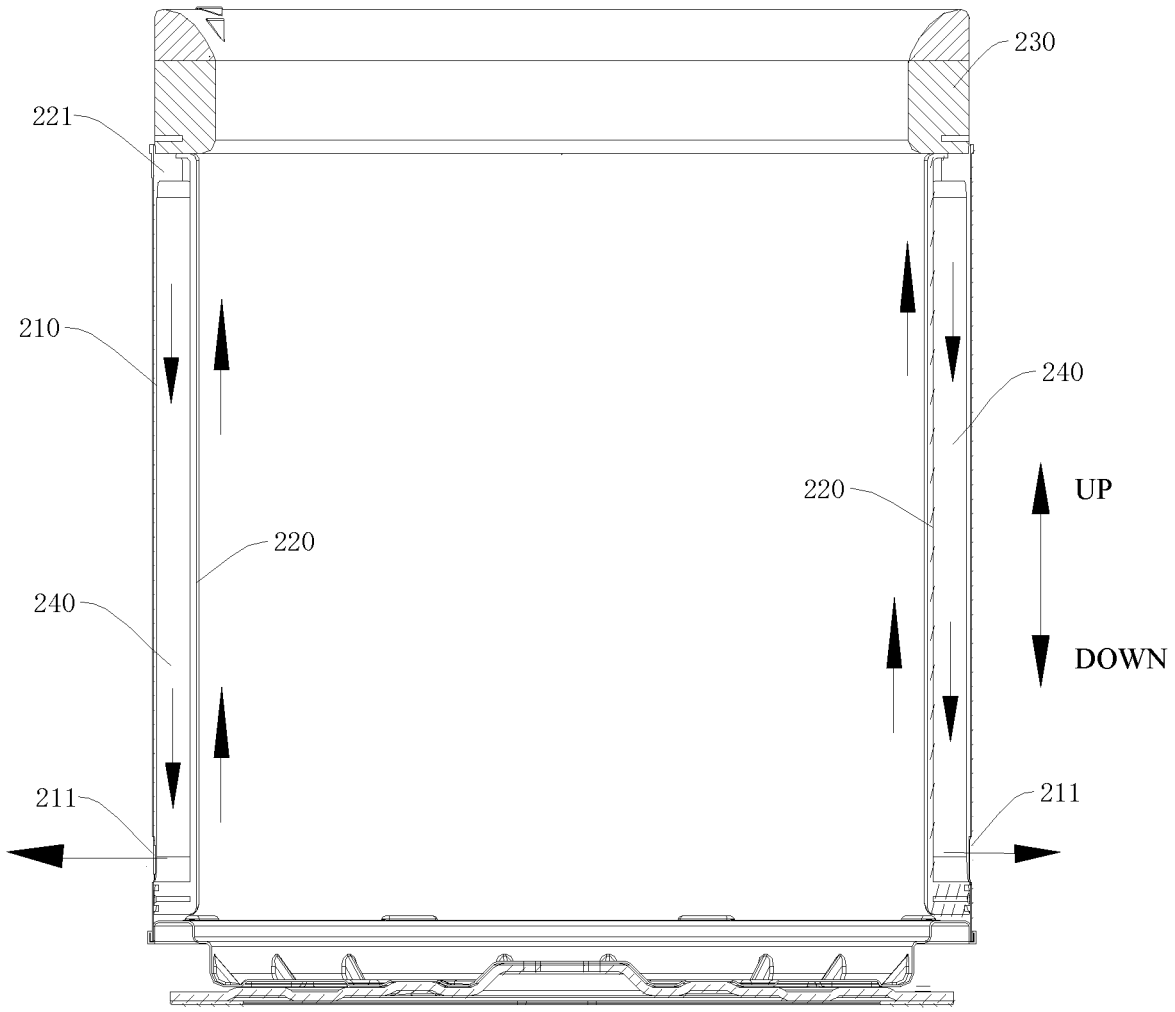
FIG. 5 is a sectional view of a rotating tub, a water guide cover and a balancing ring for a washing machine according to an embodiment of the present disclosure.
Figure 6:
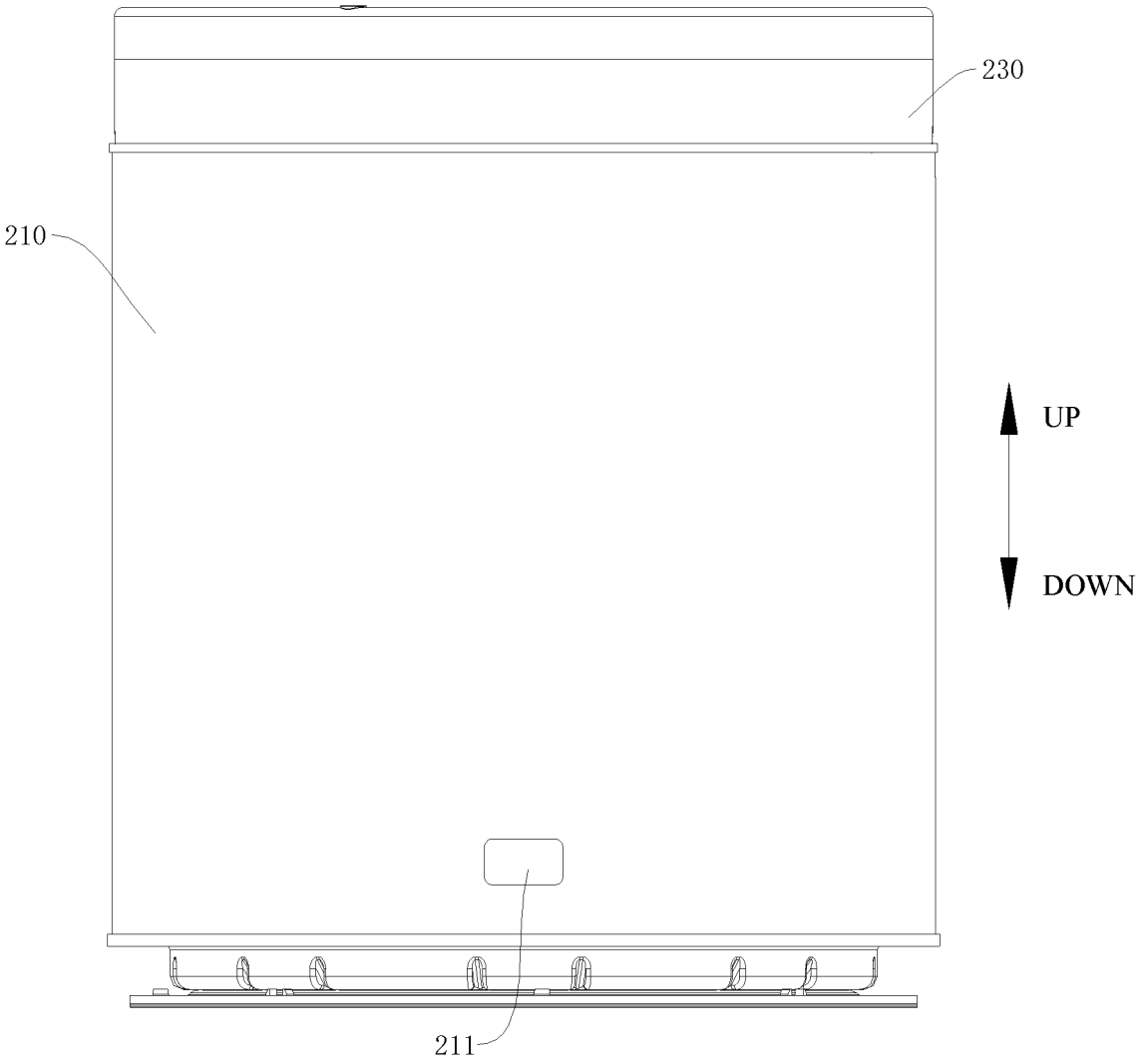
FIG. 6 is a schematic view of a rotating tub and a balance ring for a washing machine according to an embodiment of the present disclosure.

Further, as illustrated in FIGS. 1, 5 and 6, the washing machine 1 also includes a balancing ring 230 configured to maintain balance of the rotating tub 210 during rotation. The balancing ring 230 is provided at an upper end of the rotating tub 210 and connected to the upper end of the rotating tub 210. An upper end of the water guide cover 220 is located adjacent to the balancing ring 230, and the upper end of the water guide cover 220 is spaced apart from the balancing ring 230, a gap may facilitate mounting of the water guide cover 220. The water inlet 221 is provided in the upper end of the water guide cover 220. In this way, the water inlet 221 is located below the balancing ring 230, and spaced apart from the balancing ring 230 at a predetermined distance, the water in the rotating tub 210 can conveniently enter the water inlet 221 under the action of the centrifugal force during rotation of the rotating tub 210, to enter the water guide cavity 240. The upper end of the water guide cover 220 may also be connected to the balancing ring 230. In this way, the balancing ring 230 and the upper end of the water guide cover 220 cooperatively define the water inlet 221, and the water in the rotating tub 210 can conveniently enter the water inlet 221 under the action of the centrifugal force during rotation of the rotating tub 210, to enter the water guide cavity 240.

In some examples of the present disclosure, as illustrated in FIGS. 1 and 5, the upper end of the water guide cover 220 is lower than the upper end of the rotating tub 210, and a height between the upper end of the water guide cover 220 and the upper end of the rotating tub 210 is the liquid spun out of the upper end of the rotating tub 210 enters the water guide cavity 240 through the water inlet 221, to prevent the liquid splashing and spilling from the upper end of the rotating tub 210.

Further, as illustrated in FIG. 1, a side peripheral wall of the water receiving pan 400 extends upwards and is higher than the water outlet 211, the liquid in the water guide cavity 240 totally flows into the water receiving pan 400 after discharged from the water outlet 211 to prevent the water splashing and spilling from the lower end of the rotating tub 210.

In some examples of the present disclosure, as illustrated in FIGS. 1, 5 and 6, the peripheral wall of the rotating tub 210 is arranged parallel to a central axis of the rotating tub 210, and the water guide cover 220 is arranged parallel to a side wall of the rotating tub 210 and extends in an up-and-down direction. In other words, an inner diameter of the rotating tub 210 is equal everywhere in the up-and-down direction, and an outer diameter of the rotating tub 210 is equal everywhere in the up-and-down direction. It should be understood herein that, the above-described "equal everywhere" means substantially equal, and does not exclude that the rotating tub 210 is provided with some uneven structures thereon. In other words, the rotating tub 210 has a substantially cylindrical shape.

In some embodiments of the present disclosure, as illustrated in FIGS. 1, 5 and 6, the water inlet 221 is provided in an upper portion of the water guide cover 220, and the water outlet 211 is provided in a lower portion of the peripheral wall of the rotating tub 210. It could be understood herein that, the upper portion of the water guide cover 220 refers to a portion above a center of the water guide cover 220 in the up-and-down direction, and the lower portion of the rotating tub 210 refers to a portion below a center of the rotating tub 210 in the up-and-down direction. Thus, during the spin-drying, the rotating tub 201 rotates, the water in the rotating tub 210 is lifted under the action of the centrifugal force, the water inlet 221 located in the upper portion of the water guide cover 220 can better collect the lifted water, this part of water enters the water guide cover 220 via the water inlet 221, and flows to the water outlet 211 in the lower portion of the rotating tub 210 under the guidance of the water guide cover 220, to further improve the dehydration efficiency and the dehydration effect.

Further, as illustrated in FIGS. 1, 5 and 6, the water inlet 221 is provided in the upper end of the water guide cover 220, to facilitate collection of the liquid in the rotating tub 210 lifted to the upper end of the rotating tub 210 under the action of the centrifugal force. The water outlet 211 is provided in the peripheral wall of the rotating tub 210 and arranged close to the bottom wall of the rotating tub 210, and the water outlet 211 is spaced apart from the bottom wall of the rotating tub 210 at a predetermined distance. Thus, the sealing of the water guide cover 220 and the peripheral wall of the rotating tub 210 is facilitated, and a height of the side wall of the water receiving pan 400 can be reduced, to save materials and reducing costs.

In one embodiment, the water guide cavity 240 of the water guide cover 220 is defined by the water guide cover 220 alone, or defined by the water guide cover 220 and the internal peripheral wall face of the rotating tub 210 together. In other words, the water guide cover 220 may define a complete water guide cavity 240 therein, and the water guide cover 220 defines a through hole communicating the water guide cavity 240 with the water outlet 211. In one embodiment, the water guide cover 220 defines a water guide cavity 240 with an open side, and the open side of the water guide cavity 240 is closed by the internal peripheral wall face of the rotating tub 210 when the water guide cover 220 is mounted to the peripheral wall of the rotating tub 210.

Further, as illustrated in FIGS. 1, 5 and 6, in order to promote water drain effect of the washing machine 1, a plurality of water outlets 211 are provided, arranged in a circumferential direction of the rotating tub 210 and equally spaced apart from each other; a plurality of water guide covers 220 are provided, arranged in the circumferential direction of the rotating tub 210 and spaced apart from each other, and each water guide cover 220 covers at least one corresponding water outlet 211. By way of example, two water outlets 211 are provided and arranged oppositely in a radial direction of the rotating tub 210, two water guide covers 220 are provided and arranged oppositely in the radial direction of the rotating tub 210, and the two water guide covers 220 cover the two water outlets 211 respectively.

Figure 2:
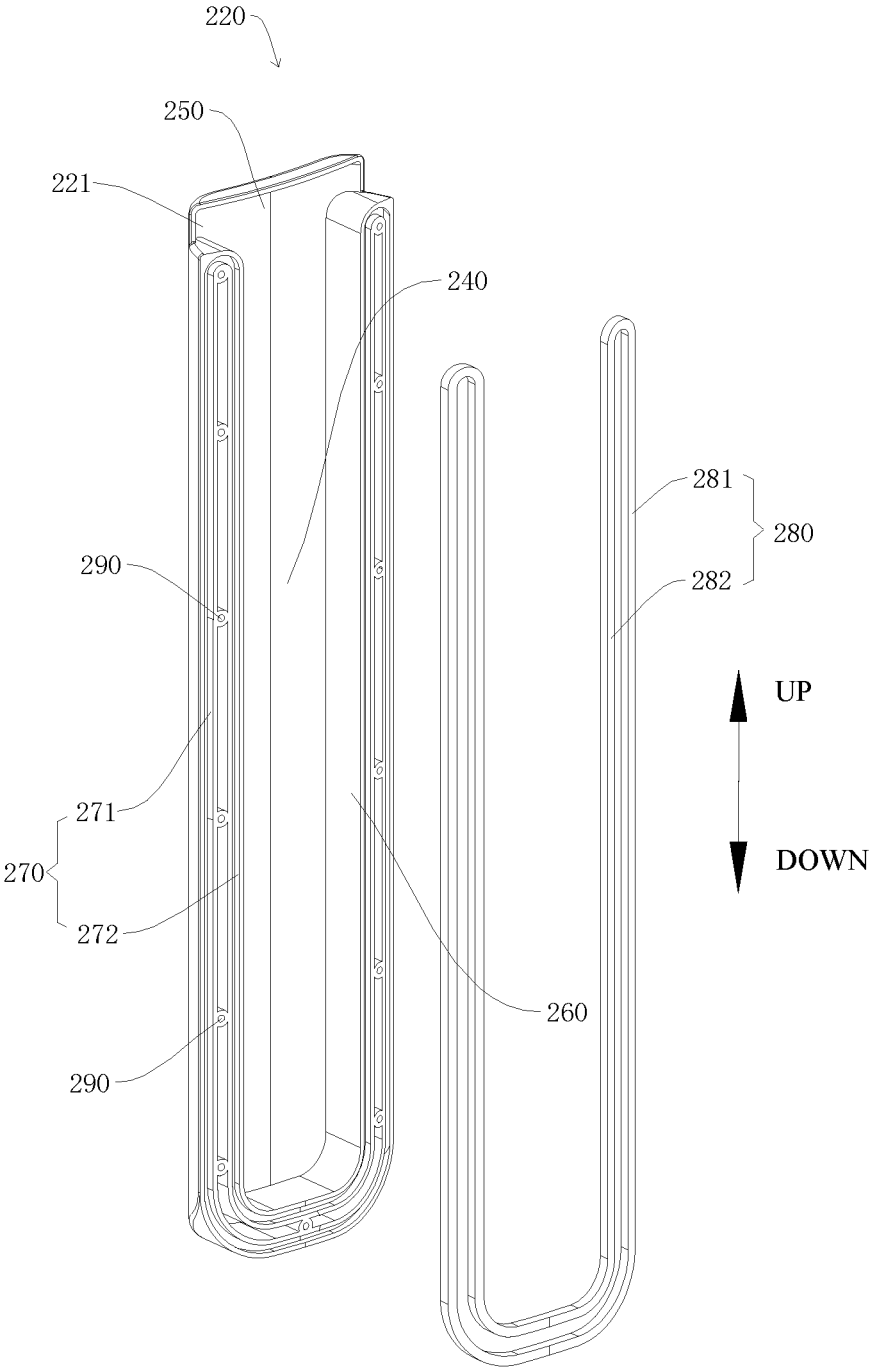
FIG. 2 is a schematic view of a water guide cover for a washing machine according to an embodiment of the present disclosure.
Figure 3:
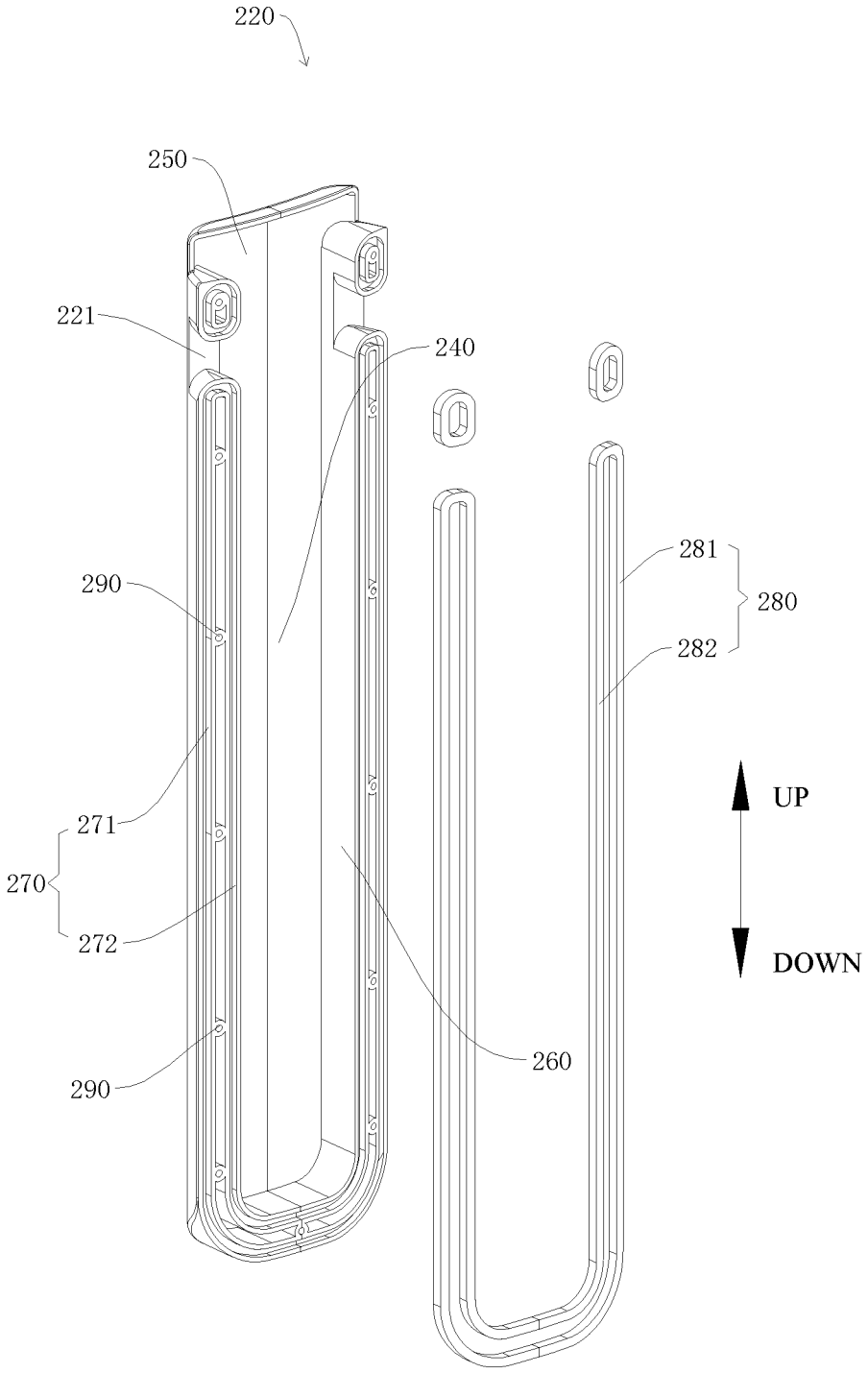
FIG. 3 is a schematic view of a water guide cover for a washing machine according to another embodiment of the present disclosure.
Figure 4:
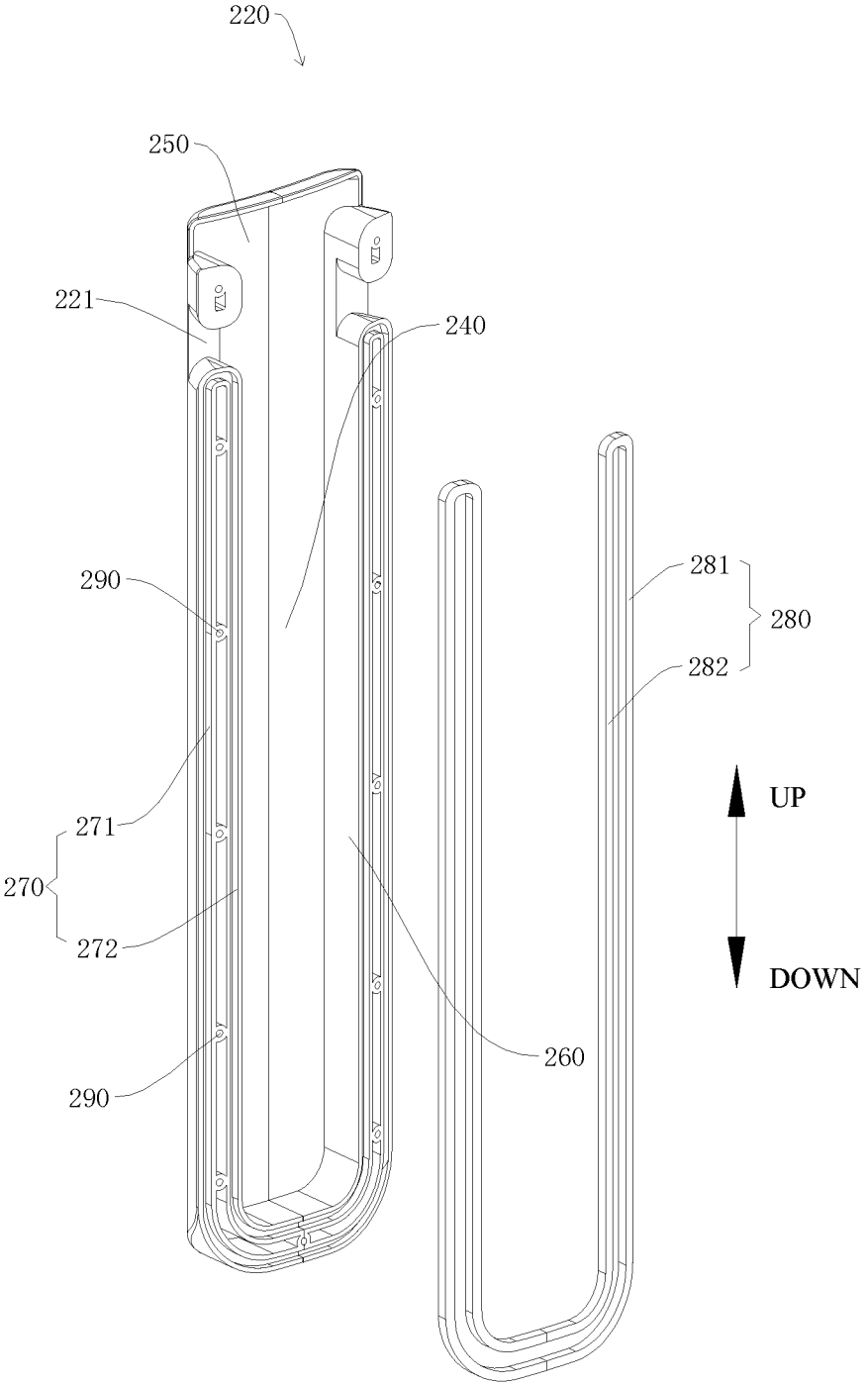
FIG. 4 is a schematic view of a water guide cover for a washing machine according to still another embodiment of the present disclosure.

In some embodiments of the present disclosure, as illustrated in FIGS. 2 to 4, the water guide cover 220 includes a water guide plate 250 and a sealing edge 260. The water guide plate 250 is spaced apart from the internal peripheral wall face of the rotating tub 210. The sealing edge 260 extends from two side edges and a lower edge of the water guide plate 250 towards and close to the internal peripheral wall face of the rotating tub 210, and the sealing edge 260 is connected with a seal to the internal peripheral wall face of the rotating tub 210. The water guide plate 250, the sealing edge 260 and the internal peripheral wall face of the rotating tub 210 cooperatively define the water guide cavity 240.

Further, as illustrated in FIGS. 2 to 4, the lower edge of the water guide plate 250 and the bottom of the sealing edge 260 is configured to be arc shapes matching each other and protruding downwards. Therefore, on the one hand, circumferential flow of the water in the rotating tub 210 during washing of the washing machine 1 may be facilitated, and resistance of the water guide cover 220 on the water flow can be reduced; and on the other hand, the water guide cover 220 may be prevented from scratching clothes.

In some embodiments of the present disclosure, as illustrated in FIGS. 2 to 4, the water inlet 211 is provided in the sealing edge 260. Thus, the water inlet 211 is defined in the side wall (i.e. the sealing edge 260) of the water guide cover 220. During spin-drying, the rotating tub 210 rotates, the water in the rotating tub 210 is rotated and lifted under the action of the centrifugal force. In this case, the water flows and ascends gradually along the circumferential direction of the rotating tub 210. The water inlet 211 is defined in the side wall (i.e. the sealing edge 260) of the water guide cover 220, the water flowing along the circumferential direction of the rotating tub 210 can enters the water inlet 211 smoothly and rapidly, to further improve dehydration effect.

Specifically, as illustrated in FIG. 2, an upper end of the sealing edge 260 is lower than an upper end of the water guide plate 250, to define the water inlet 211 in the upper end of the sealing edge 260. In other words, the water inlet 211 is located at the upper end of the sealing edge 260, and a notch defined at a height difference between the upper end of the sealing edge 260 and the upper end of the water guide plate 250 is the water inlet 211. The upper end of the sealing edge 260 may be wholly lower than the upper end of the water guide plate 250, two side walls of the water guide cover 220 each define a water inlet 211.

In one embodiment, the water inlet 211 may also not be provided in the upper end of the sealing edge 260. That is, the sealing edge 260 may define a through hole at any position of the upper portion thereof to constitute the water inlet 211.

In one embodiment, the water guide cover 220 and the rotating tub 210 may be integrally formed, or the water guide cover 220 and the rotating tub 210 may also be separately formed and then assembled together.

In some examples of the present disclosure, as illustrated in FIGS. 2 to 4, the sealing edge 260 is connected with a seal to the internal peripheral wall face of the rotating tub 210 through a sealing member 280 located between the sealing edge 260 and the internal peripheral wall face of the rotating tub 210, and the sealing member 280 is squeezed between the water guide cover 220 and the internal peripheral wall face of the rotating tub 210, to improve sealing effect of connection between the water guide cover 220 and the rotating tub 210.

Further, as illustrated in FIGS. 2 to 4, a surface of the sealing edge 260 facing the internal peripheral wall face of the rotating tub 210 is provided with a mounting groove 270, and at least a portion of the sealing member 280 is assembled in the mounting groove 270, the positioning of the sealing member 280 is realized, and relative displacement between the sealing member 280 and the sealing edge 260 is avoided, to improve the sealing effect of the sealing member 280.

In some examples of the present disclosure, as illustrated in FIGS. 2 to 4, the sealing edge 260 has a substantially U shape, the mounting groove 270 includes an outer mounting groove segment 271 and an inner mounting groove segment 272, and each of the outer mounting groove segment 271 and the inner mounting groove segment 272 has a substantially U shape. The inner mounting groove segment 272 is located at an inner side of the outer mounting groove segment 271, a first end of the outer mounting groove segment 271 is connected to a first end of the inner mounting groove segment 272 and a connected portion forms an arc-shaped transition, and a second end of the outer mounting groove segment 271 is connected to a second end of the inner mounting groove segment 272 and a connected portion forms an arc-shaped transition.

Correspondingly, the sealing member 280 includes an outer sealing strip 281 and an inner sealing strip 282, and each of the outer sealing strip 281 and the inner sealing strip 282 has a substantially U shape. The inner sealing strip 282 is located at an inner side of the outer sealing strip 281, a first end of the outer sealing strip 281 is connected to a first end of the inner sealing strip segment 282 and a connected portion forms an arc-shaped transition, and a second end of the outer sealing strip 281 is connected to a second end of the inner sealing strip 282 and a connected portion forms an arc-shaped transition.

At least a portion of the outer sealing strip 281 is fitted in the outer mounting groove segment 271, at least a portion of the inner sealing strip 282 is fitted in the inner mounting groove segment 272, and the connected portions of the two ends of the outer sealing strip 281 and the two ends of the inner sealing strip 282 are fitted with the connected portions of the two ends of the outer mounting groove segment 271 and the two ends of the inner mounting groove segment 272, respectively.

Thus, the sealing member 280 employs a sealing structure of inner and outer layers, resulting in a better sealing effect; furthermore, the mounting groove 270 employs a corresponding structure of inner and outer segments, various portions of the sealing member 280 can be positioned, to further improve the sealing effect.

Further, as illustrated in FIGS. 2 to 4, the sealing edge 260 is provided with several mounting holes 290 located between the outer mounting groove segment 271 and the inner mounting groove segment 272, the several mounting holes 290 are arranged in a U shape according to the shape of the sealing member 280, and the sealing edge 260 is mounted to the internal peripheral wall face of the rotating tub 210 through several fasteners (e.g. bolts, a screws or the like) respectively fitted in the several mounting holes 290. Thus, not only the mounting and positioning of the water guide cover 220 and the rotating tub 210 can be realized, but also the sealing member 280 can surround the fasteners to seal the fasteners, to further improve the sealing effect. The water guide cover 220 and the side wall and/or the bottom wall of the rotating tub 210 can be connected and sealed by means of at least one of welding, riveting, adhering/bonding and the like.

As illustrated in FIGS. 1 to 6, the washing machine 1 according to embodiments of the present disclosure includes a cabinet 100, a rotating tub 210 and a pulsator 300.

The rotating tub 210 is rotatably provided in the cabinet 100. The rotating tub 210 is rotatably provided in the cabinet 100, the rotating tub 210 has a peripheral wall and/or a bottom wall provided with a water outlet 211. The water guide cover 220 is provided to an internal peripheral wall face of the rotating tub 210 and covers the water outlet 211, and the water guide cover 220 is provided with a water inlet 221 and defines a water guide cavity 240 in communication with the water inlet 221 and the water outlet 211. Liquid in the rotating tub 210 lifted under the action of a centrifugal force enters the water guide cavity 240 through the water inlet 221 and is discharged through the water outlet 211. The pulsator 300 is rotatably provided in the rotating tub 210.

The washing machine 1 according to embodiments of the present disclosure employs the single tub structure to increase capacity, save water, avoid dirt and reduce costs; furthermore, not only the dehydration effect can be ensured, but also there is no limit on the materials of the cabinet, the cabinet is allowed to employ metal materials such as metal plate to promote appearance.

Other constitutions and operations of the washing machine 1 according to embodiments of the present disclosure are well known and which will not be described in detail herein.

Reference throughout this specification to "an embodiment," "some embodiments," "an illustrative embodiment", "an example," "a example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A washing machine, comprising:

a cabinet;

a rotating tub rotatably provided in the cabinet and having a peripheral wall and/or a bottom wall provided with a water outlet; and a water guide cover provided to an internal peripheral wall face of the rotating tub and covering the water outlet, the water guide cover being provided with a water inlet and defining a water guide cavity in communication with the water inlet and the water outlet, liquid in the rotating tub lifted under an action of a centrifugal force entering the water guide cavity through the water inlet and being discharged through the water outlet;

wherein the water guide cover comprises:

a water guide plate; and a sealing edge extending from the water guide plate towards and close to the internal peripheral wall face of the rotating tub, the sealing edge being connected by a seal to the internal peripheral wall face of the rotating tub, and the water guide plate, the sealing edge and the internal peripheral wall face of the rotating tub collectively defining the water guide cavity;

wherein the sealing edge extends from two side edges and a lower edge of the water guide plate towards and close to the internal peripheral wall face of the rotating tub;

wherein the lower edge of the water guide plate and a bottom of the sealing edge are configured to be arc shapes matching each other and protruding downwards.

2. The washing machine according to claim 1, wherein the water inlet is provided in an upper portion of the water guide cover, and the water outlet is provided in a lower portion of the peripheral wall of the rotating tub.

3. The washing machine according to claim 2, wherein the water inlet is provided in an upper end of the water guide cover, and the water outlet is provided close to the bottom wall of the rotating tub.

4. The washing machine according to claim 1, wherein the water guide cavity of the water guide cover is defined by the water guide cover alone, or defined by the water guide cover and the internal peripheral wall face of the rotating tub together.

5. The washing machine according to claim 1, wherein a plurality of water outlets are provided and arranged in a circumferential direction of the rotating tub and spaced apart from each other; a plurality of water guide covers are provided and arranged in the circumferential direction of the rotating tub and spaced apart from each other; and each water guide cover covers at least one corresponding water outlet.

6. The washing machine according to claim 1, wherein the water inlet is provided in the sealing edge.

7. The washing machine according to claim 1, wherein the sealing edge has an upper end lower than an upper end of the water guide plate for defining the water inlet in the upper end of the sealing edge.

8. The washing machine according to claim 1, wherein the sealing edge has a surface facing the internal peripheral wall face of the rotating tub and provided with a mounting groove, and at least a portion of the seal is assembled in the mounting groove.

9. The washing machine according to claim 8, wherein the seal comprises an outer sealing strip and an inner sealing strip located at an inner side of the outer sealing strip, and a first end of the outer sealing strip is connected to a first end of the inner sealing strip and a second end of the outer sealing strip is connected to a second end of the inner sealing strip;

the mounting groove comprises an outer mounting groove segment and an inner mounting groove segment located at an inner side of the outer mounting groove segment, and a first end of the outer mounting groove segment is connected to a first end of the inner mounting groove segment and a second end of the outer mounting groove segment is connected to a second end of the inner mounting groove segment;

wherein at least a portion of the outer sealing strip is fitted in the outer mounting groove segment, and at least a portion of the inner sealing strip is fitted in the inner mounting groove segment.

10. The washing machine according to claim 9, wherein the sealing edge is provided with several mounting holes located between the outer mounting groove segment and the inner mounting groove segment, and the sealing edge is mounted to the internal peripheral wall face of the rotating tub through several fasteners respectively fitted in the several mounting holes.

11. The washing machine according to claim 1, further comprising:

a balancing ring provided at and connected to an upper end of the rotating tub, an upper end of the water guide cover being adjacent to the balancing ring or connected to the balancing ring, and the water inlet being provided in the upper end of the water guide cover.

12. The washing machine according to claim 1, further comprising:

a water receiving pan provided in the cabinet and having at least a portion located below the rotating tub, the water guide cavity being configured to guide liquid spun out by the rotating tub to the water receiving pan through the water outlet, wherein the water receiving pan has a water receiving groove therein, and the water receiving groove is provided with a drain port at the lowest area thereof, and wherein the water receiving pan has a side peripheral wall extending upwards and higher than the water outlet.

13. The washing machine according to claim 12, further comprising:

a pulsator rotatably provided in the rotating tub.

14. The washing machine according to claim 1, wherein the water guide cover is connected to the peripheral wall and/or the bottom wall of the rotating tub by means of at least one of welding, riveting, and adhering/bonding.

15. The washing machine according to claim 1, wherein the water guide cover and the rotating tub are integrally formed; or the water guide cover and the rotating tub are separately formed and then assembled together.

16. A washing machine, comprising:

a cabinet;

a rotating tub rotatably provided in the cabinet and having a peripheral wall and/or a bottom wall provided with a water outlet;

a water guide cover provided to an internal peripheral wall face of the rotating tub and covering the water outlet, the water guide cover being provided with a water inlet and defining a water guide cavity in communication with the water inlet and the water outlet, liquid in the rotating tub under an action of a centrifugal force entering the water guide cavity through the water inlet and being discharged through the water outlet; and a pulsator rotatably provided in the rotating tub;

wherein the water guide cover comprises:

a water guide plate; and a sealing edge extending from the water guide plate towards and close to the internal peripheral wall face of the rotating tub, the sealing edge being connected by a seal to the internal peripheral wall face of the rotating tub, and the water guide plate, the sealing edge and the internal peripheral wall face of the rotating tub collectively defining the water guide cavity;

wherein the sealing edge extends from two side edges and a lower edge of the water guide plate towards and close to the internal peripheral wall face of the rotating tub;

wherein the lower edge of the water guide plate and a bottom of the sealing edge are configured to be arc shapes matching each other and protruding downwards.

* * * * *